United States Patent [19]

Suchdeo et al.

[11] Patent Number: 4,617,036

[45] Date of Patent: Oct. 14, 1986

[54] TONNAGE NITROGEN AIR SEPARATION WITH SIDE REBOILER CONDENSER

[75] Inventors: Shyam R. Suchdeo, Wescosville; Suresh U. Patel, Whitehall; Christopher F. Harris, Old Zionsville, all of Pa.

[73] Assignee: Air Products and Chemicals, Inc., Allentown, Pa.

[21] Appl. No.: 792,423

[22] Filed: Oct. 29, 1985

[51] Int. Cl.[4] ..... F25J 3/00

[52] U.S. Cl. ..... 62/11; 62/24; 62/29; 62/32; 62/42

[58] Field of Search ..... 62/9, 11, 17, 20, 24, 62/27, 29, 32, 42

[56] References Cited

U.S. PATENT DOCUMENTS

| | | | |
|---|---|---|---|
| 2,089,543 | 8/1937 | De Baufre | 62/25 |
| 2,940,269 | 6/1960 | Franier | 62/11 |
| 3,039,274 | 6/1962 | Matsch | 62/29 |
| 3,065,607 | 11/1962 | Schilling et al. | 62/29 |
| 3,086,371 | 4/1963 | Schilling et al. | 62/29 |
| 4,222,756 | 9/1980 | Thorogood | 62/13 |
| 4,332,598 | 6/1982 | Antonas et al. | 62/29 |
| 4,433,990 | 2/1984 | Olszewski | 62/29 |
| 4,453,957 | 6/1984 | Pahade et al. | 62/25 |
| 4,464,188 | 8/1984 | Agrawal et al. | 62/13 |
| 4,464,191 | 8/1984 | Erickson | 62/31 |
| 4,543,115 | 9/1985 | Agrawal et al. | 62/29 |

*Primary Examiner*—Ronald C. Capossela

*Attorney, Agent, or Firm*—Geoffrey L. Chase; E. Eugene Innis; James C. Simmons

[57] ABSTRACT

A cryogenic distillative separation of air to recover nitrogen in large quantities and at relatively high pressure wherein a portion of the nitrogen reflux for the distillation is achieved by heat exchanging nitrogen gas in a side reboiler against waste oxygen at reduced pressure.

11 Claims, 1 Drawing Figure

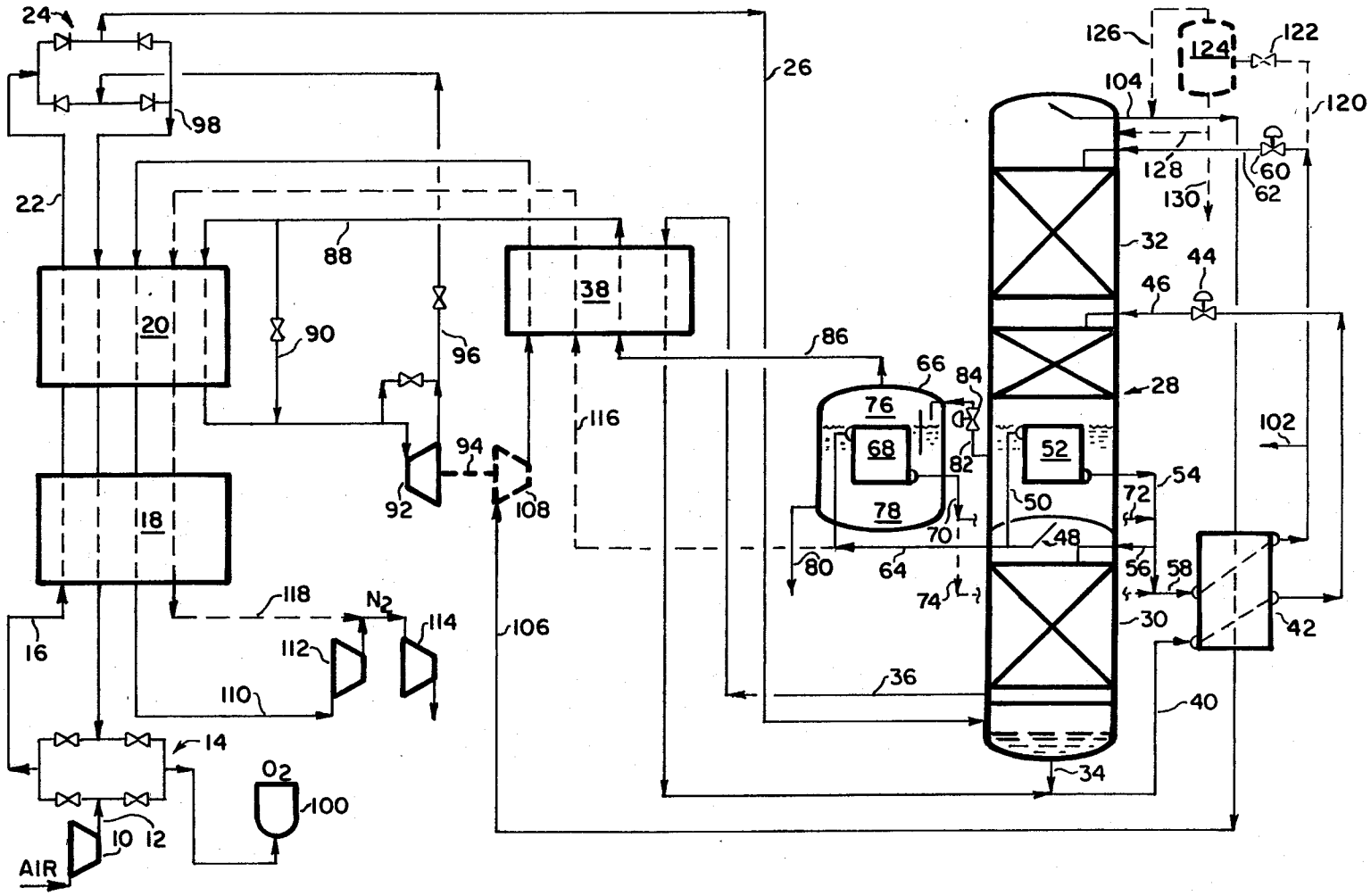
AIR
$O_2$
$N_2$

TONNAGE NITROGEN AIR SEPARATION WITH SIDE REBOILER CONDENSER

TECHNICAL FIELD

The present invention is directed to the field of cryogenic distillative air separation using a two pressure stage distillation column. More particularly, the present invention is directed to the recovery of large volumes of relatively high pressure nitrogen by the production of nitrogen reflux in a interstage reboiler condenser and a side reboiler condenser wherein the oxygen for the side reboiler condenser is reduced in pressure.

BACKGROUND OF THE PRIOR ART

The prior art of air separation to produce oxygen and nitrogen through cryogenic distillative separations is well developed. Initially, the industrial gas industry sought to maximize the production of oxygen and to recover it at high purities. When developing oxygen recovery distillation systems, the resulting nitrogen by-product had typically been considered a waste stream having low nitrogen purity. In recent years, nitrogen as a product has developed a commercial significance. Nitrogen is typically utilized as an inerting medium. As such a medium, it was typically required in relatively small amounts or volumes. However, with the depletion of petroleum reservoirs, the need for various forms of enhanced recovery, such as secondary and tertiary recovery techniques for petroleum has been appreciated. Nitrogen has recently been utilized as an inert gas medium which may be utilized to assist in the production of petroleum reservoirs. This use of nitrogen, unlike most uses of nitrogen in the past, requires large volumes of nitrogen at very low per unit costs and at pressures significantly higher than most past uses so as to be readily adaptable to the high pressure conditions of enhanced petroleum recovery operations. Therefore, a need presently exists for a process to produce large volumes of nitrogen at relatively high pressure at a relatively low per unit cost for uses, such as in enhanced petroleum recovery operations.

The art of cryogenic air separation has typically used one or more pressure stages in a distillation column to effect the separation of nitrogen and oxygen from air. For instance, in U.S. Pat. No. 2,089,543, two separate flowschemes for the separation of air into oxygen and nitrogen are shown. In FIG. 1 of that patent, a single stage distillation is illustrated. In FIG. 2 of that patent, a two pressure stage distillation column is shown having an interstage reboiler condenser F and a side reboiler condenser H. The side reboiler produces nitrogen reflux in heat exchange against oxygen liquid from the low pressure stage G of the distillation column. It is apparent that the side reboiler in the oxygen flow passages is at the same pressure as the low pressure stage of the distillation column as is apparent from open lines 37, 38 and 39. In addition, the reboiler condenser F and side reboiler condenser H of that patent operate in series oxygen flow for the heat exchange function and production of nitrogen reflux. By maintaining the pressure of side reboiler H at the pressure of the low pressure stage G, the feed air compression to the high pressure stage E of the distillation column of this patent remains relatively high.

U.S. Pat. No. 4,464,191 discloses a three column cryogenic distillative separation of air into oxygen and two pressure ranges of nitrogen. Side column 5 rectifies an oxygen enriched fluid from low pressure stage 2 into an oxygen product and a further purified nitrogen stream which is returned to the low pressure stage 2. The use of nitrogen from the high pressure stage 1 introduced into the overhead condenser 9 and eventually recovered reduces the overall nitrogen recovery that is possible from a cryogenic distillative separation.

Other high volume nitrogen recovery cryogenic distillative separation systems are disclosed in U.S. Pat. Nos. 4,222,756, 4,453,957 and 4,464,188, none of which utilize a side reboiler to increase the efficiency of nitrogen product recovery.

BRIEF SUMMARY OF THE INVENTION

The present invention is a process for producing large quantities of nitrogen at a relatively high pressure by the cryogenic separation of air in a two stage distillation column comprising the steps of compressing a feed airstream to an elevated pressure and removing water and carbon dioxide from the compressed air, cooling the compressed air against rewarming process streams by indirect heat exchange, introducing at least a portion of the cooled airstream into the high pressure stage of said distillation column, removing a bottom stream from the high pressure stage of the distillation column, reducing its pressure and introducing it into the low pressure stage of the distillation column, removing a gaseous nitrogen stream from the top of the high pressure stage of the distillation column and condensing a portion of it against oxygen enriched liquid in the bottom of the low pressure stage of the distillation column to produce a first liquid nitrogen stream, removing oxygen enriched liquid from the bottom of the low pressure stage of the distillation column and reducing its pressure, condensing another portion of the gaseous nitrogen stream from the high pressure stage against the reduced pressure oxygen enriched liquid from the bottom of the low pressure stage to provide a gaseous oxygen enriched stream and a second liquid nitrogen stream, returning a first portion of the first and/or second liquid nitrogen streams to the high pressure stage of the distillation column as reflux, reducing in pressure and introducing a second portion of the first and second liquid nitrogen streams to the low pressure stage of the distillation column as reflux, removing a gaseous nitrogen product from the low pressure stage of the distillation column and rewarming the gaseous oxygen enriched stream and expanding it through an expansion turbine to produce refrigeration for the process by heat exchanging the expanded oxygen enriched stream against process streams.

Preferably, another portion of the gaseous nitrogen stream from the high pressure stage of the distillation column is removed as a product.

Preferably, the expansion of the gaseous oxygen enriched stream is performed in an expansion turbine and a part of the work of the turbine is used to compress the gaseous nitrogen product of the process.

Preferably, gaseous nitrogen product is removed from the high pressure stage and the low pressure stage of the distillation column as product.

Preferably, the nitrogen product is recovered at a pressure in the range of 30 to 150 psia, optimally in the range of 45 to 70 psia.

Preferably, the nitrogen recovery from the cryogenic distillative separation is 77% of the nitrogen processed, optimally, 94% of the nitrogen processed.

BRIEF DESCRIPTION OF THE DRAWING

The FIGURE is a schematic representation of the cryogenic distillative separation of the present invention showing various alternative embodiments in dotted line configuration.

DETAILED DESCRIPTION OF THE INVENTION

The present invention incorporating a side reboiler condenser on a two stage distillation column wherein the waste oxygen liquid transferred from the low pressure stage of that column to the side reboiler after its pressure has been reduced provides the unique advantage to the cryogenic distillative separation of nitrogen from air whereby alternatively either power requirements may be reduced for given production of nitrogen or higher pressure nitrogen can be produced at a fixed power requirement. The latter proposition is highly attractive to the production of nitrogen for high pressure end use, such as enhanced petroleum recovery operations as well as other high pressure nitrogen utilizations such as blending inert gas with a high pressure natural gas stream to adjust BTU levels. The reduction in pressure of the waste oxygen into the side reboiler condenser in contrast to the lower pressure stage of the distillation column allows the same composition and quantity of waste oxygen to be exhausted from the separatory system for expansion to produce refrigeration and cleanup in the heat exchangers as if a side reboiler condenser were not used, while preserving a relatively higher pressure nitrogen product emanating from the low pressure stage of the distillation column. Alternatively, if lower pressure nitrogen product is acceptable, the reduction in pressure of the oxygen from the low pressure stage to the side reboiler allows the high pressure stage of the distillation column to be operated at a lower pressure which translates into a power savings for the main feed air compressor. Therefore, the present invention utilizing a side reboiler condenser with an oxygen pressure let down provides a unique advantageous improvement over known air separation systems whereby alternatively nitrogen at relatively high pressure can be produced at relatively high volumes and recoveries or energy requirements in the form of power required for the main feed air compressor can be reduced to provide a more economical nitrogen product.

Lower unit cost or alternatively higher pressure product are both desirable attributes of an air separation system that produces nitrogen wherein the nitrogen is desired for use in high volumes and high pressure, particularly the end uses recited above. Therefore, the present invention provides a beneficial solution to the problem of producing low cost or high pressure nitrogen for high demand, high pressure utilizations.

Typically in a two stage cryogenic distillative separation of air, an interstage reboiler condenser is situated between the low pressure and the high pressure stages of the column. Waste oxygen enriched liquid in the bottom of the low pressure stage heat exchanges with gaseous nitrogen from the top of the high pressure stage to provide nitrogen reflux liquid to the high pressure stage necessary for rectification in that stage, while at the same time providing vaporous oxygen enriched reboil for the low pressure stage which again is necessary for efficient rectification in that stage. Typically, a waste oxygen enriched stream must be removed from the low pressure stage to balance the mass flow in the separatory system and to provide appropriate thermodynamic balancing in the refrigeration and precooling of process streams to and from the distillation column. Therefore, limitations are set on the pressure that can be achieved in the low pressure column where the final nitrogen product is produced because the low pressure stage pressure limit affects the amount of waste oxygen recovered in cooperation with the temperature of the interstage reboiler condenser. The use of a side reboiler condenser alone would not change this pressure-temperature dependence for nitrogen product and waste oxygen effluent. Effectively, the same limitations would exist on the system. However, in the present invention wherein a side reboiler condenser is utilized with communication of oxygen liquid from the low pressure stage of the distillation column to the side reboiler condenser, wherein the pressure of the oxygen is reduced through an appropriate valving means to provide a low pressure waste oxygen enriched liquid in the side reboiler condenser, an advantageous degree of freedom in the operation of the cryogenic distillative separation is achieved. The reduction in pressure of the oxygen communicated from the low pressure stage to the side reboiler condenser allows the reboiler condenser to be operated at a colder temperature to provide adequate reflux and reduced pressure requirements in the high pressure stage, or alternatively, the pressure reduction of the oxygen communicated from the low pressure stage to the side reboiler condenser allows the reboiler condenser to be run at a set temperature while the low pressure stage of the distillation column is run at a considerably higher pressure. This higher pressure in the low pressure stage of the distillation column translates into higher pressure nitrogen product for potential end use. High pressure nitrogen product saves on the energy of compression used for the air feed to the plant, particularly when the end use of the nitrogen product is in a high pressure application such as enhanced petroleum recovery.

By reducing the pressure of the waste oxygen enriched liquid communicating from the low pressure stage of the column to the side reboiler condenser, the same compositional waste oxygen vapor at similar flow rates can be discharged from the side reboiler condenser for production of plant refrigeration and cleanup duty, as would normally have been required and achieved from the reboil of the low pressure stage of the column.

Utilizing the process arrangement of the present invention, it is also possible to recover a portion of the nitrogen vapor from the high pressure stage of the distillation column as high pressure nitrogen gas product, or alternatively, a liquid nitrogen product.

Having set forth the advantage of the present invention over the prior art, the invention will now be described with regard to a specific preferred embodiment and several alternative embodiments with reference to the drawing. Feed air is compressed to a pressure of approximately 116 psia in feed air compressor 10 and then fed through line 12 to a switching valve system 14 whereby the feed air is alternatively passed through alternative passages of reversing heat exchangers. In one particular switched mode, the feed air is introduced into the heat exchangers through line 16 whereby it is precooled in heat exchanger 18 and 20 against process streams before leaving the heat exchangers at a reduced temperature in line 22. The cooled feed air, which is cleansed of water, carbon dioxide and other condensables in the reversing heat exchangers, then passes through a second switching valve assembly 24 before being introduced into a two pressure stage cryogenic distillation column 28 through line 26. Alternatively, the feed air could be passed through molecular sieve beds to remove water and carbon dioxide and thereby avoiding the reversing pattern in the heat exchangers.

The feed air is initially rectified in the high pressure stage 30 of the column 28 whereby a nitrogen vapor is produced and an oxygen enriched liquid is produced. A portion of the partially rectified air is removed in line 36 and indirectly heat exchanged with process streams in heat exchanger 38 to recover refrigeration for the distillative separation. An oxygen enriched liquid bottom stream is removed in line 34 and combined with the stream in line 36 to produce a combined bottom stream in line 40 which is subcooled in subcooling heat exchanger 42 and reduced in pressure in valve 44 before being introduced into the low pressure stage 32 of the column 28 in line 46. This low pressure stage of the distillation column is preferably operating at a pressure of 60 psia.

The gaseous nitrogen produced at the top of the high pressure stage 30 is removed from that stage in line 48 and a portion in line 50 is indirectly heat exchanged with oxygen enriched liquid in the base of the low pressure stage 32 in a reboil condenser 52. This indirect heat exchange produces oxygen enriched reboil vapor which ascends the low pressure stage 32 and a first liquid nitrogen stream in line 54. Another portion of the gaseous nitrogen stream in line 48 is removed in line 64 to be indirectly heat exchanged in side reboiler condenser 66 against oxygen enriched liquid of reduced pressure from that of the low pressure stage 32. This indirect heat exchange forms a second liquid nitrogen stream in line 70 and an oxygen enriched gas 76 in the free board of the side reboiler condenser 66. The oxygen enriched gas is removed in line 86 as a gaseous oxygen enriched stream which is rewarmed by indirect heat exchange against process streams in heat exchanger 38 before being delivered in line 88 to heat exchanger 20 wherein a portion of the stream is bypassed in line 90. The combined stream is then reduced in pressure by passage through an expansion turbine 92 to produce the refrigeration for the entire plant. The cold expanded gaseous oxygen enriched stream is then removed in line 96, switching valve assembly 24 and line 98 to provide refrigeration to the incoming feed air by indirect heat exchange in heat exchanger 20 and 18 before further passing through switching valve assembly 14 and being removed as a waste oxygen enriched vent stream in outlet 100.

The liquid nitrogen stream in line 54 and the liquid nitrogen stream in line 70 both constitute produced nitrogen liquid which can be combined by passage of the stream in line 70 through line 72 and mixing with the stream in line 54 or by passage of the stream in line 70 through line 74 in combination with the stream in line 54 further downstream. In either event, a first portion of the produced liquid nitrogen is returned to the high pressure stage 30 of the column 28 in line 56 to supply reflux for the rectification occurring in the high pressure stage 30. Accordingly, using the alternative 74 allows the reflux 56 to be formed from either only the first liquid nitrogen stream or if the alternative 74 is not used, the reflux is formed from a portion of all of the produced liquid nitrogen. A second portion of the produced liquid nitrogen in line 58 is subcooled in subcooling heat exchanger 42, reduced in pressure in valve 60 and introduced by way of line 62 into the top of the low pressure stage 32 of the column 28 at a pressure of approximately 60 psia. A nitrogen slipstream may be removed in line 102.

This nitrogen liquid provides reflux for the low pressure stage 32, while reboil for the stage 32 is provided from the reboil condenser 52. A high purity gaseous nitrogen product is removed from the overhead of the low pressure stage 32 typically at a purity of at least 95% nitrogen or better such as 0.5 ppm impurity in the nitrogen product. This nitrogen is removed in line 104, rewarmed in subcooling heat exchanger 42 and further rewarmed in line 106 through heat exchanger 38, 20 and 18 before being removed in line 110 as product and optionally compressed to a higher pressure in compressor 112 and compressor 114.

Alternatively, the liquid nitrogen in line 58 can be introduced into a phase separation vessel 124 through line 120 and valve 122 to produce a gaseous nitrogen product in line 126 which can be combined with the gaseous nitrogen product in line 104 while a liquid nitrogen reflux to the low pressure stage 32 is supplied through line 128 from the phase separation vessel 124. Additionally, a liquid nitrogen product can be removed in line 130 as long as the quantity does not exceed the reflux requirements of the low pressure stage 32.

Oxygen enriched liquid at approximately 60 psia in the low pressure stage 32 of the column 28 is removed in line 82 and reduced in pressure through valve 84 before being introduced as an oxygen enriched liquid at approximately 45 psia into the side reboiler condenser 66. The reduced pressure oxygen enriched liquid 78 in the side reboiler condenser 66 allows the reboiler condenser heat exchanger 68 to operate at a lower temperature yet still provide the same composition of oxygen enriched gas 76 which can be removed from the side reboiler condenser for refrigeration and cleanup duty. Again, this reduction in pressure either allows an increase in the pressure of the low pressure stage of the distillation column or allows for a reduction in the pressure of the high pressure stage of the column with the resulting effect that either high pressure nitrogen can be recovered from the overall system or lower energy costs are incurred in compressing air to the high pressure stage of the column. Either of these alternatives can be accomplished while keeping the same specifications for the waste oxygen enriched stream that is removed from the overall process, in this instance in the side reboiler condenser 66.

One other alternative can be utlized in the present invention to further enhance the energy efficiency and the pressure of the resulting nitrogen product. Nitrogen product removed in line 106 may be compressed in a compressor 108 which is either directly mechanically linked to the expansion turbine 92 or linked through some power transmission identified by line 94. This recovery of energy from the expansion turbine 92 results in the reduction in the energy requirements of any downstream compression in compressors 112 and 114 of the nitrogen product in line 110. Accordingly, any nitrogen product removed from the high pressure stage 30 in line 116 and line 118 could be added or blended with the nitrogen product in line 118 interstage of the final compression requirements due to the difference in the pressure levels of these potential products.

The process set forth above and its various alternatives is capable of producing a nitrogen gas product in the medium pressure range of 30 to 150 psia, preferably 45 to 70 psia, and optimally at approxlmately 60 psia. The nitrogen recovery of the overall cryogenic distillative separation system is at least 77% of the nitrogen processed and preferably 94% or better of the nitrogen processed. The nitrogen purity would be 95% or greater. The present invention provides a unique advantage over the prior art producing relatively large volumes of high pressure, high purity nitrogen, such as is presently in demand in industry. The utilization of a side reboiler condenser with reduction in oxygen pressure allows the present invention to meet plant mass flow and thermodynamic requirements, while giving the flexibility of reduction in power input or increase in nitrogen pressure, which is highly desirable in the economic circumstances presently existing for industrial gas utilization.

The present invention has been described with reference to a preferred embodiment, but it is believed the full scope of the invention should be ascertained from the claims which follow.

We claim:

1. A process for producing large quantities of nitrogen at relatively high pressure by the cryogenic separation of air in a two stage distillation column comprising the steps of:

(a) compressing a feed air stream to an elevated pressure and removing water and carbon dioxide from the compressed air;

(b) cooling the compressed air against rewarming process streams by indirect heat exchange;

(c) introducing at least a portion of the cooled air stream into the high pressure stage of said distillation column;

(d) removing a bottom stream from the high pressure stage of the distillation column, reducing its pressure and introducing it into the low pressure stage of the distillation column;

(e) removing a gaseous nitrogen stream from the top of the high pressure stage of the distillation column and condensing a portion of it against oxygen-enriched liquid in the bottom of the low pressure stage of the distillation column to produce a first liquid nitrogen stream;

(f) removing oxygen-enriched liquid from the bottom of the low pressure stage of the distillation column and reducing its pressure;

(g) condensing another portion of the gaseous nitrogen stream from the high pressure stage of step (e) against the oxygen-enriched liquid of step (f) to provide a gaseous oxygen-enriched stream and a second liquid nitrogen stream;

(h) returning a first portion of the first and/or second liquid nitrogen streams to the high pressure stage of the distillation column as reflux;

(i) reducing in pressure and introducing a second portion of the first and second liquid nitrogen streams to the low pressure stage of the distillation column as reflux;

(j) removing a gaseous nitrogen product from the low pressure stage of the distillation column, and (k) rewarming the gaseous oxygen-enriched stream of step (g) and expanding it through an expansion turbine to produce refrigeration for the process by heat exchanging the expanded oxygen-enriched stream against process streams.

2. The process of claim 1 wherein another portion of the gaseous nitrogen stream from the high pressure stage of the distillation column is removed as product.

3. The process of claim 1 wherein the second portion of the first and/or second liquid nitrogen stream of step (i) is reduced in pressure, phase separated, the liquid phase is introduced into the low pressure stage of the distillation column and the gas phase is removed as gaseous nitrogen product.

4. The process of claim 3 wherein a portion of the liquid phase is removed as liquid nitrogen product.

5. The process of claim 1 wherein the compressed air is cooled against process streams in reversing heat exchangers.

6. The process of claim 5 wherein the gaseous oxygen-enriched stream after expansion is used to clean up water and carbon dioxide deposited in reversing heat exchangers.

7. The process of claim 5 wherein the expansion of the gaseous oxygen-enriched stream is performed in an expansion turbine and a portion of the work of the turbine is used to compress the gaseous nitrogen product of the process.

8. The process of claim 1 wherein gaseous nitrogen product is removed from the high pressure stage and the low pressure stage of the distillation column.

9. The process of claim 1 wherein water and carbon dioxide are removed from the feed air in molecular sieve adsorbent beds.

10. The process of claim 1 wherein the gaseous nitrogen product is recovered at a pressure in the range of 30 to 150 psia.

11. The process of claim 1 wherein the nitrogen recovery is 77% or greater.

* * * * *